United States Patent [19]

Cordier et al.

[11] Patent Number: 4,649,867

[45] Date of Patent: Mar. 17, 1987

[54] COAL GASIFICATION REACTOR OF THE TYPE EMPLOYING A BATH OF LIQUID METAL

[75] Inventors: Jean Cordier, Saint-Saulve; Marcel Lemaire, Gif-sur-Yvette, both of France

[73] Assignee: Union Siderurgique Du Nord et L'Est de La France (USINOR), Puteaux, France

[21] Appl. No.: 703,658

[22] Filed: Feb. 21, 1985

[30] Foreign Application Priority Data

Feb. 23, 1984 [FR] France ..... 84 02771

[51] Int. Cl.[4] ..... C10J 1/04

[52] U.S. Cl. ..... 122/5; 48/92; 110/229

[58] Field of Search ..... 48/77, 67, 85.2, 101, 48/92, 197 R, 210; 110/229; 122/5

[56] References Cited

U.S. PATENT DOCUMENTS 2,965,461 12/1960 Walker .
4,388,084 6/1983 Okane et al. ..... 48/92 X
4,459,137 7/1984 Tanoue et al. ..... 48/92 X

FOREIGN PATENT DOCUMENTS 2950865 6/1981 Fed. Rep. of Germany .
2445364 7/1980 France .
52-41605 3/1977 Japan .

OTHER PUBLICATIONS

Patents Abstracts of Japan "Gasifying Method for Coal", vol. 6, No. 149, Aug. 10, 1982.
Chemical Abstracts, vol. 87, No. 18, Oct. 1977.

*Primary Examiner*—Edward G. Favors
*Attorney, Agent, or Firm*—Cushman, Darby & Cushman

[57] ABSTRACT

This reactor for the gasification of solid fuels in the powdered form, of the type employing a bath of liquid metal (5) comprises: a substantially cylindrical vessel (1) which has a substantially oblong section and lateral walls (2) and a bottom wall (3) which are lined with a refractory lining (4), this vessel further comprising an orifice (37) for discharging the bath of liquid metal, and an orifice (36) for discharging slag supernatant on the bath of liquid metal (5), a dome (11) positioned in a sealed manner on the vessel (1) and having in its upper part in the vicinity of one of the ends of the vessel a sealed box (16) for introducing an injecting branch (17) and, also in its upper part, but at the opposite end of the vessel, an orifice (21) of large section for exhausting the gases produced, and a roughly central orifice (29) for introducing addition elements; and means (8, 9, 10*a–e*, 6, 13, 14, 15) for cooling the lateral walls and the bottom wall of the vessel and the dome.

10 Claims, 1 Drawing Figure

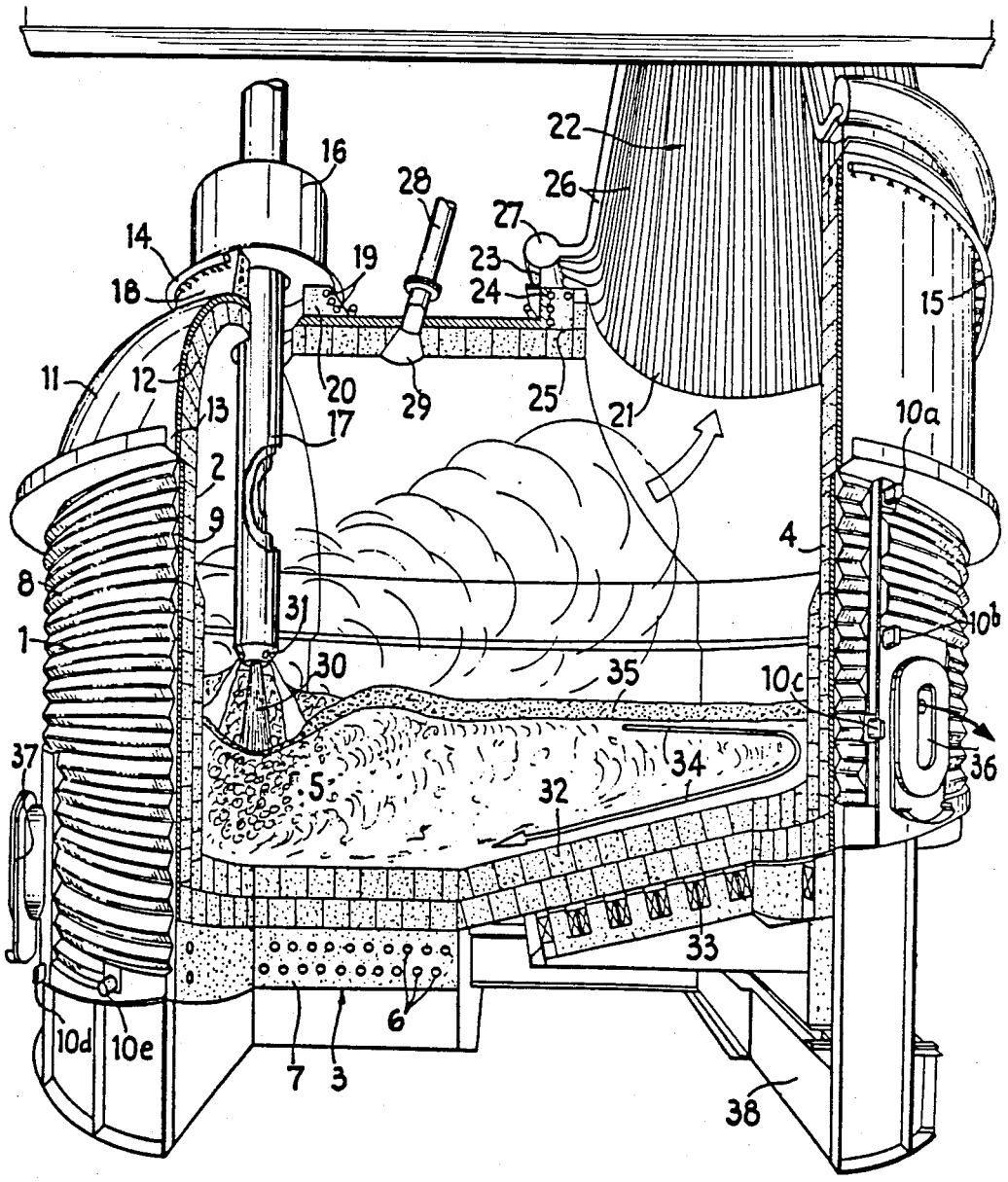
22
16
28
26
27
14
19
23
24
18
15
11
12
20
29
25
21
10a
13
17
2
9
4
8
31
10b
1
30
35
10c
37
5
34
36
32
33
6
10d
10e
7
3
38

COAL GASIFICATION REACTOR OF THE TYPE EMPLOYING A BATH OF LIQUID METAL

The present invention relates to a coal gasification reactor of the type employing a bath of liquid metal.

Coal gasification reactors are known in which powdered coal is injected through a bath of liquid metal by means of nozzles placed in the bottom of a reactor whose inner walls are covered with a refractory lining adapted to withstand the stresses produced by the liquid metal.

These reactors have a construction similar to that of steel-making converters and they are provided with trunnions permitting a tilting about a horizontal axis in particular for reasons of essential regular access for the maintenance of the nozzles and the repairing of the refractory lining.

The first drawback of this type of reactor resides, in fact, in the tilting design which is necessary and does not permit the construction of vessels of large diameter lined with a refractory lining which is thick and suitably cooled, owing to the weight inherent in these features.

The lack of cooling, combined with the relatively small thickness of the refractory lining of tiltable reactors results in a rapid wear of the lining which requires frequent repairs which have an adverse effect on the operational availability of the apparatus and its operating cost.

Moreover, it is difficult to ensure a good fluid-tightness of tiltable reactors, so that entries of air or losses of gas may occur and the increase in the operating pressure, which would have a favourable effect on the operation of the apparatus and on its economy, is limited.

Further, as the gasification capacity of a tuyere is limited, the installation of many tuyeres for an industrial unit complicates the technical construction and the distribution of the coal and gases between the tuyeres.

The bottom tuyeres create an excellent stirring of the various reagents but result, on the other hand, in a rapid wear of the refractory lining which, especially on the bottom, in the region of the tuyeres, cannot be very thick owing to the tiltable design of the unit and which does not include an effective cooling as mentioned before.

The tuyeres themselves must be effectively cooled, usually by a liquid or gaseous hydrocarbon or by a liquified gas ($CO_2$), the cost of this cooling agent increasing very substantially the cost of the gas produced from the coal.

Reactors are known for gasifying coal on a bath of liquid metal in which powdered coal is injected by means of a branch or nozzle whose jet is projected onto the surface of the bath, but these reactors are also still of the tiltable type and have the same drawbacks as those indicated before, which limit the profitability and efficiency. In particular, their excessively small inner volume does not enable the gas to reach the equilibrium of the reactions and moreover adversely affects the good performance of the refractory linings in the region of the belly.

Further, the excessively small area of the interface between the bath of liquid metal and the slag produced by the fusion of the ashes, does not permit a good decantation of the balls of metal in the slag and produces a costly loss of liquid metal which adversely affects the good valorization of this slag.

An object of the present invention is to overcome these drawbacks and to provide a reactor whose operational availability is greater and which is simpler and more continuous to work, and which produces a gas of high quality and a valorizable slag from the ashes.

The invention therefore provides a reactor for the gasification of solid fuels in the powdered form, of the type comprising a vessel containing a bath of liquid metal and an injection branch for the fuel located in the upper part of the enclosure, said reactor comprising a substantially cylindrical vessel which has an oblong section in a plane perpendicular to the generatrices and includes lateral walls and a bottom wall lined with a refractory lining and defining a discharge orifice for the supernatant slag on the surface of the metal, and a discharge orifice for the metal, a dome bearing with a fluid-tight joint on the vessel and defining at least one orifice for introducing at least one vertical injection branch through a sealed box, an orifice of large section for discharging the gases produced in the reactor, said two orifices being disposed respectively in the vicinity of the opposed ends of the reactor, and an orifice for introducing addition elements, means being provided for cooling the lateral walls and the bottom wall of the vessel and the dome, the vessel comprising at least one bottom part in the shape of an inclined plane, so that the depth of the bath of liquid metal is maximum in the region located below the injection branch and minimum in the region located below the gas discharge orifice.

The invention will be described hereinafter with reference to the accompanying drawing, which shows merely one embodiment.

The single Figure is a perspective view partly in section of the reactor according to the present invention.

The gasification reactor shown in the Figure comprises a steel vessel 1 of substantially cylindrical shape having an oblong section, a lateral wall 2 and a bottom wall 3 which are lined on their inner side with a refractory lining 4. This refractory lining has a double thickness in the lower region of the vessel, i.e. in the region in contact with the bath of liquid metal 5 constituting the crucible.

The bottom wall 3 of the vessel is cooled by means of a system of tubes 6 for the circulation of a cooling fluid, these tubes being embedded in a layer 7 of refractory lining, such as a refractory concrete, disposed between the refractory lining 4, and the bottom wall 3.

The lateral wall 2 of the vessel is lined along its outer surface with a casing 8 of corrugated shape which defines with the shell of the vessel passageways 9 for the circulation of a cooling fluid which communicate with an outer cooling circuit through orifices 10*a*, 10*b*, 10*c*, 10*d*, 10*e*, etc. . . This circuit is subjected to a forced and pressurized circulation of the fluid by means not shown.

The vessel 1 is surmounted by a dome 11 which is also provided inside with a refractory lining 12 the connection between the dome 11 and the upper edge of the vessel 1 being achieved in a sealed manner. A channel 13 constituting a gutter encircles the outer wall of the reactor in the region of the junction between the dome 11 and the vessel 1 for collecting cooling fluid which runs down the dome from spraying racks 14, 15 placed in the upper part of the dome.

The dome 11 has in its upper part, vertically above the large diameter of the section of the vessel, an orifice 16*a* surmounted by a fluid-tight box 16 for introducing an injection branch or nozzle 17 in a projecting position close to the lateral wall, i.e. close to an end of large diameter.

This box 16 is received on a seat 18, the seal between the seat 18 and the box 16 being ensured by a mechanical joint. The seat 18 is cooled internally by a circular network of tubes 19 for circulating a cooling fluid and embedded in a refractory lining 20 disposed along the inner wall of the seat.

Further, in order to ensure the fluid-tightness in the region of the orifice for introducing the injection branch 17, which is movable in vertical translation by means not shown , the box 16 is pressurized by the blowing of an inert gas such as steam or carbon dioxide.

The dome 11 also includes in its upper part an orifice 21 for discharging the gases produced, this orifice being of large diameter and centered, in projection on the large diameter of the vessel, in a position relatively close to the end opposed to that at which the branch 17 is located. The orifice 21 is surmounted in a sealed manner by an exhaust flue 22 which is in the illustrated embodiment a high-pressure frustoconical direct-radiation boiler. This boiler 22 is received on a seat 23 which is provided in the upper part of the dome and is cooled, as the seat 18, by a network of circular tubes 24 embedded in a refractory lining 25.

This boiler 22 is formed by welded adjoining tubes 26 connected at their lower entrance to a circular manifold 27 supplying superheated water of 40 to 60 bars.

The dome 11 includes in its upper part a spout 28 for introducing addition elements and opening onto the inner volume of the vessel through an orifice 29 which extends through the refractory lining. The spout 28 is located between the box 16 and the boiler 22 and is inclined in such manner that the addition elements reach the bath of liquid metal 5 in the region of impact of the jet issuing from the branch 17.

The branch 17 is formed by a tube having a quadruple casing or jacket defining four concentric annular spaces.

A jet 30 of powdered coal containing optionally additives and conveyed by steam, is directed onto the surface of liquid metal 5 by the central cylindrical conduit of the branch 17. Sent through the annular space immediately adjacent to the central conduit are oxygen and water vapour, these gases being projected into the depression region of the bath created by the impact of the jet 30 through orifices 31, the outermost annular spaces of the branch 17 being provided for a circulation of fluid for cooling the branch.

According to an essential feature of the present invention, the bottom wall of the vessel has a region 32 in the shape of an inclined plane in the part thereof which is not exposed to the depression created on the surface of the bath of liquid metal 5 by the jet 30 of powdered coal issuing from the injection branch 17.

This inclined bottom wall defines two distinct regions of the liquid metal bath 5, namely a first region of greater depth for the chemical reactions of gasification of the coal with an intense stirring, and a second region 32 which has a gradually decreasing depth and has for function to achieve an equilibrium of the reactions and a decantation between the metal and the slag.

There may moreover be disposed under the part 32 of the bottom wall in the shape of an inclined plane a device 33 for effecting an electromagnetic stirring which has a favourable effect on the decantation of the bath 5 by a circulation in a path shown by the arrow 34.

A layer of slag 35 which is supernatant on the bath of metal 5 is periodically discharged in a regulatable manner through a tap-hole 36 located at the end of the region of the bath having a small depth, at the level of the layer of slag.

A tap-hole 37 for the metal of the bath is provided at the end opposed to the tap-hole 36 for the slag in the region of great depth and in the lower part of the crucible.

The bath is formed by a metal in which carbon can exist in the dissolved state and is, for example, cast iron, the physico-chemical properties of which are adjusted by addition elements as a function of the temperature of operation.

The non-tiltable vessel 1 of the reactor is mounted on a metal frame 38. The assembly can be shifted in horizontal translation by shifting means not shown .

The reactor operates in the following manner :

Solid cast iron and/or scrap iron and ferro-silicon and coke are introduced, and then there are blown into the branch 17 oxygen and powdered coal which is ignited.

In the starting-up stage, the gases produced are oxidized gases which have no value and are eliminated. The bath of liquid iron is formed and there are added through the spout 29, in addition to powdered lime supplied in the jet of powdered coal, addition elements in the form of rocks such as fluxes and melting agents, and optionally lime, dolomite, iron scraps and ferro alloys.

When the bath is established at a given composition and temperature, the injection of powdered coal is increased and the height of the branch 17 is adjusted to its optimum position which is neither too high for avoiding a gas oxidized by the oxygen which escapes, nor too low so as to avoid being deteriorated by the molten metal. The gasification of the coal is then conducted continuously in accordance with thermodynamic and chemical equilibriums.

An important feature of the reactor of the present invention resides in the large free volume above the bath of liquid metal, which has a favourable effect on the establishment of gaseous reaction equilibriums for obtaining a gas of good quality.

Thus, owing to its fixed non-tiltable position, the reactor according to the present invention can be provided with a cooling of the best quality and a greater thickness of the refractory lining which determine the life and consequently the availability of the installation which is capable of producing gas in a practically uninterrupted manner.

Bearing in mind the large dimensions of the reactor, the quantity of liquid metal contained in the reactor is larger and therefore permits achieving a higher unitary gasification capacity without resulting in excessive wear of the refractory linings.

Further, the large free surface of the bath of liquid metal permits a longer period of stay of the slag, and therefore a better obtainment of the chemical reaction equilibriums and a better decantation of the balls of metal entrained by the slag.

The variation in the depth of the bath also permits the provision of a region of high mechanical stirring due to the impact of the jet from the branch 17, where the reactions are more rapid, and a relatively calm decantation region above the inclined plane 32.

It will be observed that the decrease in the depth of the bath permits,in addition to the favourable effect exerted on the decantation, reducing the weight of the liquid metal present in the reactor for a given depth required in the region of impact of the jet and consequently lightening the supporting structures.

The decantation region thus created permits the obtainment by a simple pouring of a well-decantated slag whose rate of discharge may be regulated and this allows a treatment by granulation for the purpose of preparing clinkers which are valorizable in the cement industry.

Owing to its fluid-tightness, the reactor according to the invention may be worked in a pressurized manner and therefore made to increase its unit yield and its profitability.

What is claimed is:

1. A reactor for the gasification of solid fuels in the powdered form, said reactor comprising a substantially cylindrical vessel which contains a bath of liquid metal and has an oblong shape in a plane perpendicular to the generatrices of the vessel and comprises lateral walls and a bottom wall, a refractory lining on the lateral walls and bottom wall, means defining a discharge orifice for a slag supernatant on the surface of the bath of liquid metal, means defining a discharge orifice for said liquid metal, a dome bearing on the vessel with a sealed joint and defining at least one orifice for introducing at least one substantially vertical injection branch, a sealed box mounted on the dome and surrounding the injection branch, means defining an orifice of large section for exhausting gases produced in the reactor, said two discharge orifices being disposed respectively in the vicinity of opposite ends of the reactor, means defining an orifice for introducing addition elements, means for cooling the lateral walls and the bottom wall of the vessel and the dome, the vessel comprising at least one bottom part in the shape of an inclined plane so that the depth of said bath of liquid metal is maximum in a region located below the injection branch and minimum in a region located below the orifice for exhausting the gases.

2. A reactor according to claim 1, wherein an electromagnetic stirring device is placed below said bottom part of the vessel in the shape of an inclined plane.

3. A reactor accordingto claim 1, comprising a system of tubes for circulating a cooling fluid and embedded in a layer of refractory lining located between said refractory lining and said bottom wall for cooling the bottom of the vessel.

4. A reactor according to claim 1, comprising a jacket of corrugated shape defining passageways for the circulation of a cooling fluid in a forced and pressurized manner, said jacket extending alongside an outer side of said lateral wall.

5. A reactor according to claim 1, comprising spraying racks for supplying a cooling fluid which runs along the dome for cooling the dome, and a gutter encircling an outer wall of the reactor at a level of the junction between the dome and the vessel.

6. A reactor according to claim 1, wherein the sealed box is received with a sealed joint on a seat which is internally cooled by a system of tubes for circulating a cooling fluid embedded in a refractory lining placed along an inner wall of the seat.

7. A reactor according to claim 1, wherein the orifice for exhausting the gases produced is surmounted in a sealed manner by a high-pressure direct-radiation boiler.

8. A reactor according to claim 7, wherein the boiler comprises adjoining tubes defining a frustoconical inner radiation volume, said tubes being connected at a lower entrance end to a circular manifold supplying superheated water, the boiler being received with a sealed joint on a seat cooled internally by a system of tubes for circulating a cooling fluid embedded in a refractory lining placed along an inner wall of the seat.

9. A reactor according to claim 1, wherein an inclined spout opens onto the orifice for introducing addition elements so that the addition elements reach the bath of liquid metal in a zone of impact of the jet issuing from the branch.

10. A reactor according to claim 1, wherein the injection branch comprises a tube having a quadruple casing defining four separate concentric spaces, namely a central space serving to inject powdered coal conveyed by a neutral gas, an immediately adjacent space serving to inject oxygen and steam, and outer spaces serving to circulate a cooling fluid.

* * * * *